US006481175B2

(12) United States Patent
Potter et al.

(10) Patent No.: US 6,481,175 B2
(45) Date of Patent: Nov. 19, 2002

(54) STRUCTURAL MEMBER

(75) Inventors: Graeme George Potter, Burbank (AU); Peter Anthony Ryan, Penrith (AU); Cecil Benjamin Appleton, Yeronga (AU)

(73) Assignee: Rocheway Pty. Ltd., Burbank (AU)

( * ) Notice: Subject to any disclaimer, the term of this patent is extended or adjusted under 35 U.S.C. 154(b) by 0 days.

(21) Appl. No.: 09/921,289

(22) Filed: Aug. 3, 2001

(65) Prior Publication Data

US 2002/0038533 A1 Apr. 4, 2002

Related U.S. Application Data

(63) Continuation of application No. PCT/AU00/00072, filed on Feb. 8, 2000.

(51) Int. Cl.[7] ..... E04C 2/32; E04C 2/38; E04C 3/09

(52) U.S. Cl. ..... 52/634; 52/481.1; 52/789.1; 52/791.1; 52/792.1

(58) Field of Search ..... 52/634, 633, 636, 52/673, 675, 696, 481.1, 731.7, 731.8, 731.9, 789.1, 791.1, 792.1, 733.2; 29/897.3, 897.31, 897.312, 897.32, 897.35; 428/596, 597, 132, 134, 135, 136

(56) References Cited

U.S. PATENT DOCUMENTS

| | | | | | |
|---|---|---|---|---|---|
| 2,088,781 | A | * | 8/1937 | Folsom | 52/634 X |
| 2,138,291 | A | * | 11/1938 | Callaghan | 52/634 X |
| 2,246,578 | A | * | 6/1941 | De Salardi | 52/634 X |
| 2,423,682 | A | | 7/1947 | Castle | |
| 3,008,551 | A | * | 11/1961 | Cole | 52/791.1 X |
| 3,696,578 | A | * | 10/1972 | Swensen et al. | 52/789.1 |
| 4,426,824 | A | * | 1/1984 | Swensen | 52/791.1 |
| 4,793,113 | A | * | 12/1988 | Bodnar | 52/481.1 |
| 5,527,625 | A | | 6/1996 | Bodnar | |
| D438,987 | S | * | 3/2001 | Ryan et al. | D25/102 |

FOREIGN PATENT DOCUMENTS

| | | | | |
|---|---|---|---|---|
| AU | 477444 | | 10/1974 | |
| GB | 1442891 | * | 7/1976 | 52/731.7 |
| GB | 1603516 | | 11/1981 | |
| WO | WO 89/03920 | * | 5/1989 | 52/634 |
| WO | WO 00/47839 | * | 8/2000 | |

* cited by examiner

*Primary Examiner*—Laura A. Callo
(74) *Attorney, Agent, or Firm*—Shoemaker and Mattare

(57) ABSTRACT

A structural member including a web portion having a plurality of triangular regions to provide additional strength and stiffness. The triangular regions are recessed from the web and may have a floor area or the floor may be cut out to provide apertures with lip portions. An additional element secures a flanged bracing panel in the opening between the studs and the top and bottom plates of a building frame and clads both sides of the braced frame.

10 Claims, 11 Drawing Sheets

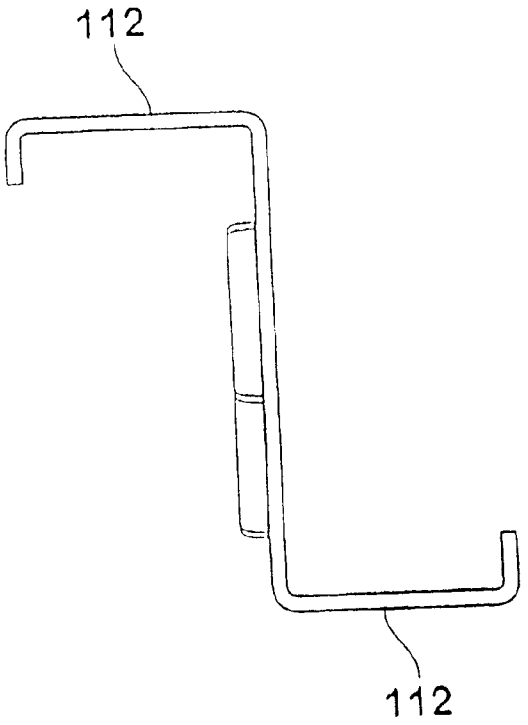
Fig. 11
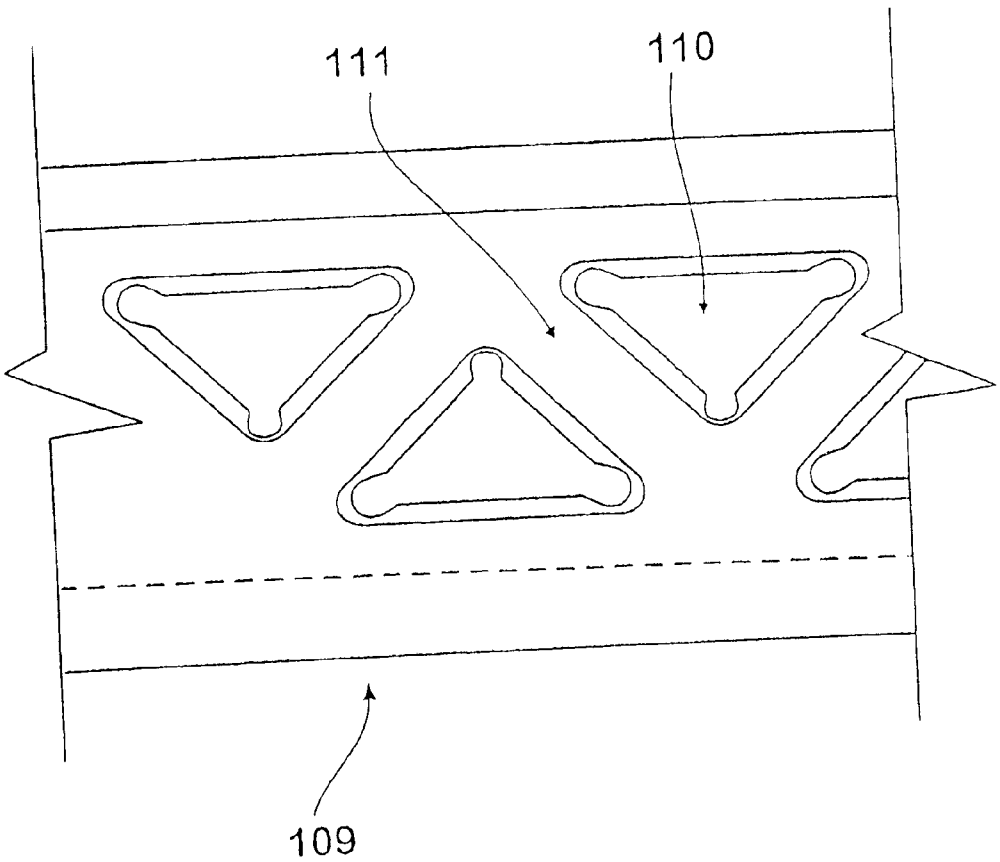

STRUCTURAL MEMBER

This application is a continuation of international application No. PCT/AU00/00072, filed Feb. 8, 2000.

FIELD OF THE INVENTION

This invention relates to bracing panels, their application and to methods of building utilising such bracing panels. The present invention also relates to studs, purlins, beams and other similar structural members.

PRIOR ART

Most building constructions, whether they are made of timber or metal, utilise slender elongate frame members connected together in end abutting relationship to form open perimeter or ladder type frames. Typically these frames include a series of spaced vertical studs extending between top and bottom plates. The connection between the studs and plates is generally not of the type which will permit moment transfer between the stud and plates to a sufficient degree to resist operational racking loads.

Accordingly such frames are not able to withstand racking loads without significant deflection. Typically these frames are braced with either internal or external structural panels such as plywood panels extending continuously between adjacent studs and top and bottom plates so as to stiffen the structure and provide it with the strength to withstand racking loads. Typically these are applied by wind loadings and offset vertical loadings.

While the use of plywood panels to provide the requisite strength and stiffness is widespread, the dynamic loads which may be applied by wind loadings and other loads frequently loosen the mechanical fastenings securing the plywood panel to the studs and plates and this severely weakens the structure. The provision of the plywood panels protruding from the common plane containing the aligned faces of the studs also creates problems in the application of the external cladding to the studs.

The present invention aims to provide an alternate structural member for use in bracing perimeter or ladder type frames.

SUMMARY OF THE INVENTION

The present invention in one aspect resides broadly in a structural member including a web portion having a plurality of substantially triangular cutouts, each of said cutouts is defined by a side edge portion displaced from the plane of the web portion and including an intermediate portion and a lip extending inwardly within the cutout.

In another aspect the invention broadly resides in a structural member including a web portion having a plurality of substantially triangular recesses, each of said recesses is defined by three intermediate portions and a floor portion positioned between the intermediate portions and displaced from the plane of the web portion.

The terms cutouts and recesses will hereinafter be referred to as recesses. The lip and the floor portion in a preferable form are stepped from the plane of the web portion. The web portion adjacent the cutout or recess, the intermediate portion and the lip or the floor portion preferably provide two discontinuities that impart rigidity to the structural member. The web portion adjacent the cutout or recess, the intermediate portion and the lip or the floor portion may form a substantially Z-shaped cross section. The Z-shaped cross section provides the structural member with additional stiffness and strength.

Each triangular recess may substantially be in the shape of an equilateral triangle. Each triangular recess may have three corner edge portions. Each corner edge portion is preferably bent at substantially right angles from the plane of the web portion. Each corner edge portion is preferably rounded or arcuate to prevent points of weakness from being formed.

The web portion in one embodiment includes one or more ribs formed in a non-apertured portion of the web portion preferably in the direction along the length of the structural member to provide additional stiffness. The web portion may have a checker plate configuration. This may restrict screw pullout.

The structural member is preferably a one piece member. The triangular recesses are preferably punched or pressed. The structural member is preferably made of light gauge metal. In one form the structural member is preferably formed from a light weight galvanized steel sheet.

The structural member in one form is a bracing panel and the recesses are arranged to provide continuous strut portions extending between opposed longitudinal edges of the panel. Preferably the arrangement of the recesses provides a plurality of continuous panel portions extending between the top and bottom edges of the panel, and strut portions extending between respective continuous panel portions. Suitably the strut portions are not in alignment across the web portion although they may be if so desired. Furthermore the strut portions may extend in one direction at one end of the panel and in the opposite direction at the opposite end of the panel.

In one embodiment there is a plurality of substantially triangular recesses or cutouts, each of the triangular cutouts or recesses form a substantially equilateral triangle, the cutouts or recesses are arranged in pairs with opposed side edges and each pair of cutouts or recesses are in the same orientation relative to adjacent cutout or recess pairs.

In another embodiment the triangular cutouts or recesses form a substantially equilateral triangle, the cutouts or recesses are arranged in pairs with opposed side edges and each pair of cutouts or recesses diagonally opposed to another pair of cutouts or recesses is orientated substantially 90 degrees relative to each other. With this arrangement of triangular recesses or cutouts a series of short diagonal struts joined to transverse extending portions or struts is formed and allows force directed along the diagonal struts to be readily dissipated thereby substantially avoiding a line of weakness from being formed within the panel.

There may be three to five vertical rows of triangular recess pairs depending on the width of the panel and the desired perimeter margin. The dimensions of the triangular recesses may vary between different panels. In one preferred embodiment of a bracing panel there are three vertical rows of triangular recess pairs wherein each triangular recess has side edge portions that are 89 mm in length.

The bracing panel may have one or more perimeter flanges. The perimeter flanges border the web portion. Preferably the perimeter flanges are formed as folded edge portions of the one piece structural member. Preferably there are attachment means that attach one or more of the perimeter flanges to adjacent supports such as vertical studs and top and bottom plates.

Suitably the flanges have returned free edge portions and preferably the lower flange is reinforced to permit the bracing panel to be through bolted to the bottom plate or building foundation such that in use, the bracing panel may extend upwardly therefrom in a cantilever manner so as to resist racking loads applied to the framing. Suitably, at least one edge of the panel is mechanically fastened to a stud and the upper edge of the panel is fastened to the top plate.

It is also preferred that the overall thickness of the panel at the flanges be less than the thickness of the framing with which the panel is to be used so that the bracing panel can be contained wholly within cladding applied to opposite faces of the framing.

The width of the bracing panel may vary depending on the spacing between the studs. In one embodiment the width of the bracing panel suitably permits fitting between studs with standard stud spacings.

In one preferred embodiment the panel may be fixed to the bottom flange by anchor bolts into the concrete foundations of bottom plate. The top flange may be bolted through the top plate with random nailing along the sides. The mounting to the concrete foundations or bottom plate may be supported by positioning of bolts or other suitable fasteners through one or more of the side flanges adjacent the bottom flange to the opposing stud or bottom plate.

In another form the structural member is a suitable support such as C-section members such as studs, Z-section members such as purlins, and box section members such as beams. In this form the triangular recesses are preferably positioned along one or more longitudinal rows whereby each recess is orientated at substantially 180 degrees relative to the adjacent recess.

In another aspect, this invention resides broadly in a method of bracing a framed structure including providing a bracing panel of the type variously described above, securing that panel between the top and bottom members of the perimeter frame.

Preferably the overall thickness of the bracing panel is less than the width/thickness of the frame members such that the bracing panel may be secured to the inner faces of the frame members inwardly from the opposed outer edges thereof.

It is also preferred that at least one longitudinal edge of the bracing panel be mechanically fastened to the internal face of an adjacent one of the stud members which forms the perimeter frame.

In another aspect, this invention resides broadly in a method of forming a structural member as described above including:

providing feedstock of sheet metal;

feeding the sheet metal to a forming station;

forming triangular recesses as described above and forming a desired recess arrangement in the sheet metal, the recesses being punched or pressed so as to have a side edge portion displaced from the plane of the web portion and including an intermediate portion and a lip extending inwardly within the cutout; and folding peripheral edge portions of the sheet to form peripheral flanges.

In yet another aspect this invention resides broadly in a building method including forming a circumferentially flanged rectangular bracing panel from sheet metal;

locating the bracing panel within an opening formed between studs and top and bottom plates;

bolting the lower flange of the bracing panel to the bottom plate and any foundation member there beneath, and securing the remaining flanges to the adjacent studs and top plate, and applying cladding to opposite faces of the studs and plates so as to enclose the bracing panel there between.

The panel web portion of the bracing panel may be substantially planar but preferably the bracing panel is of a form as variously described above.

Preferably the recesses have edges that are folded to provide additional strength and stiffness to prevent fatigue and tearing. Preferably the folded sections extend substantially inwardly. Preferably the folded sections fold along each side of the recess. The folded section may include an inwardly extending portion and a return flange which may extend substantially parallel to the panel web portion. Preferably the comers of the recesses are arcuate or rounded to prevent points of weakness from being formed and dissipate stress forces.

The shape of the recess provides the panel and structural member with additional strength and stiffness. As well the arrangement of the recesses relative to each other as described herein provides the panel and structural member with additional strength against torsional forces and racking loads.

BRIEF DESCRIPTION OF THE FIGURES

In order that this invention may be more readily understood and put into practical effect, reference will now be made to the accompanying drawings which illustrate typical embodiment of this invention and wherein:

FIG. 11 is plan and sectional views of a Z section according to the present invention.

DETAILED DESCRIPTION OF THE PREFERRED EMBODIMENT

Figure 1A:
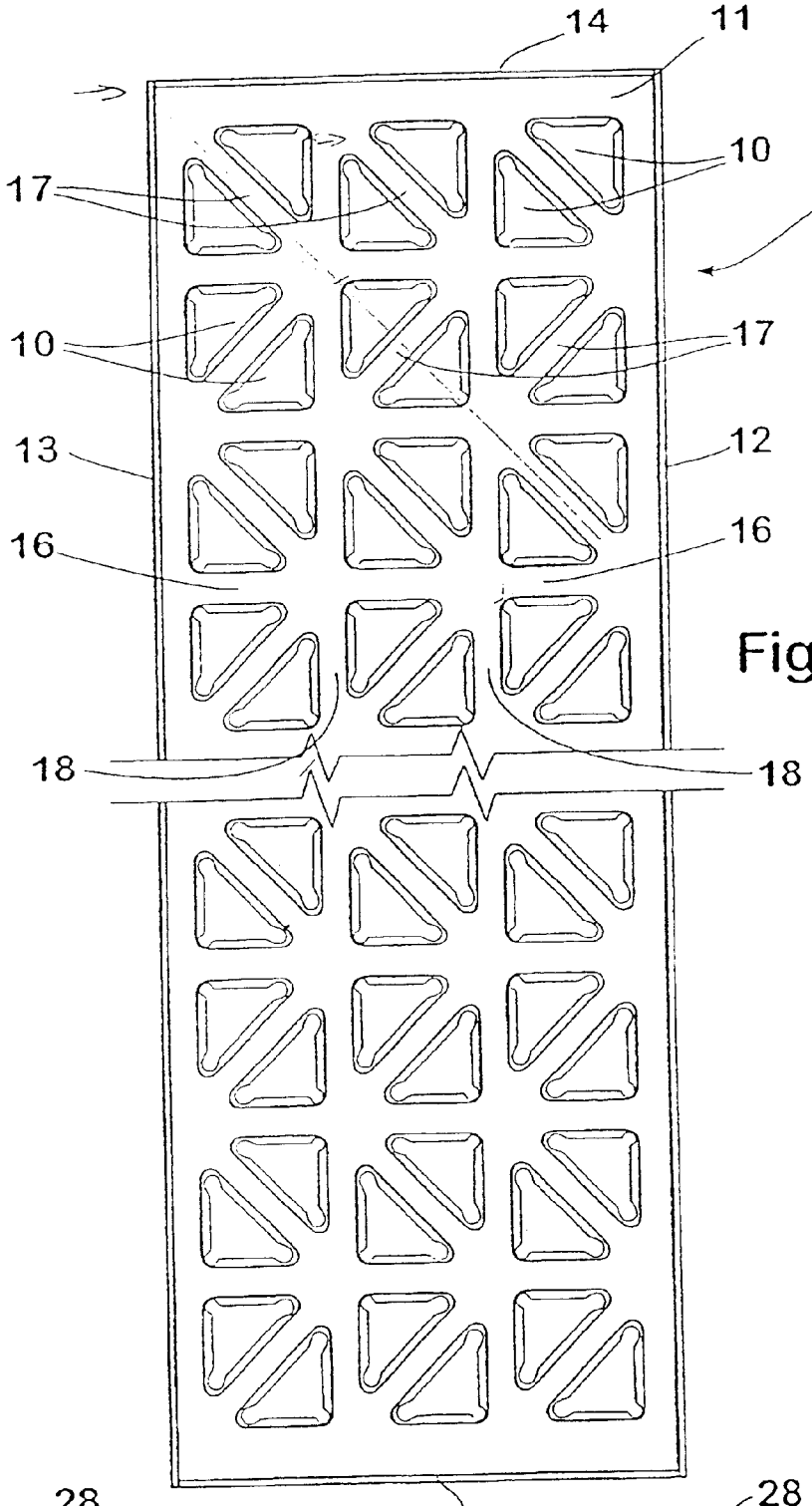
FIG. 1*a* is a cutaway plan view of one form of bracing panel according to the present invention and FIG. 1*b* is a cross section of the bracing panel.
Figure 1B:
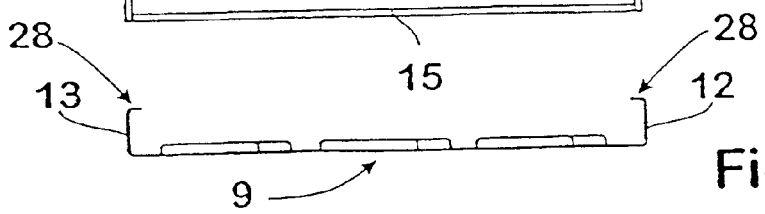

Referring to FIG. 1, it will be seen that a bracing panel 9, formed according to one configuration is formed from light gauge sheet steel having a panel web portion 11 extending between opposed side flanges 12 and 13 and top and bottom flanges 14 and 15 respectively. The bracing panel 9 is a one piece member and does not require welding or any other form of joining to be formed.

The panel web portion 11 is provided with triangular cutouts 10 arranged in a geometric pattern so as to form transverse and diagonal strut portions 16 and 17 respectively extending between the opposed side flanges 12 and 13 and intermediate continuous panel portions 18 which extend between the top and bottom flanges 14 and 15.

It will be seen that in this embodiment the geometric arrangement of the cutouts 10 is such as to create diagonal strut portions 17 in alignment across the panel web portion 11 between the opposed side flanges 12 and 13.

Figure 2A:
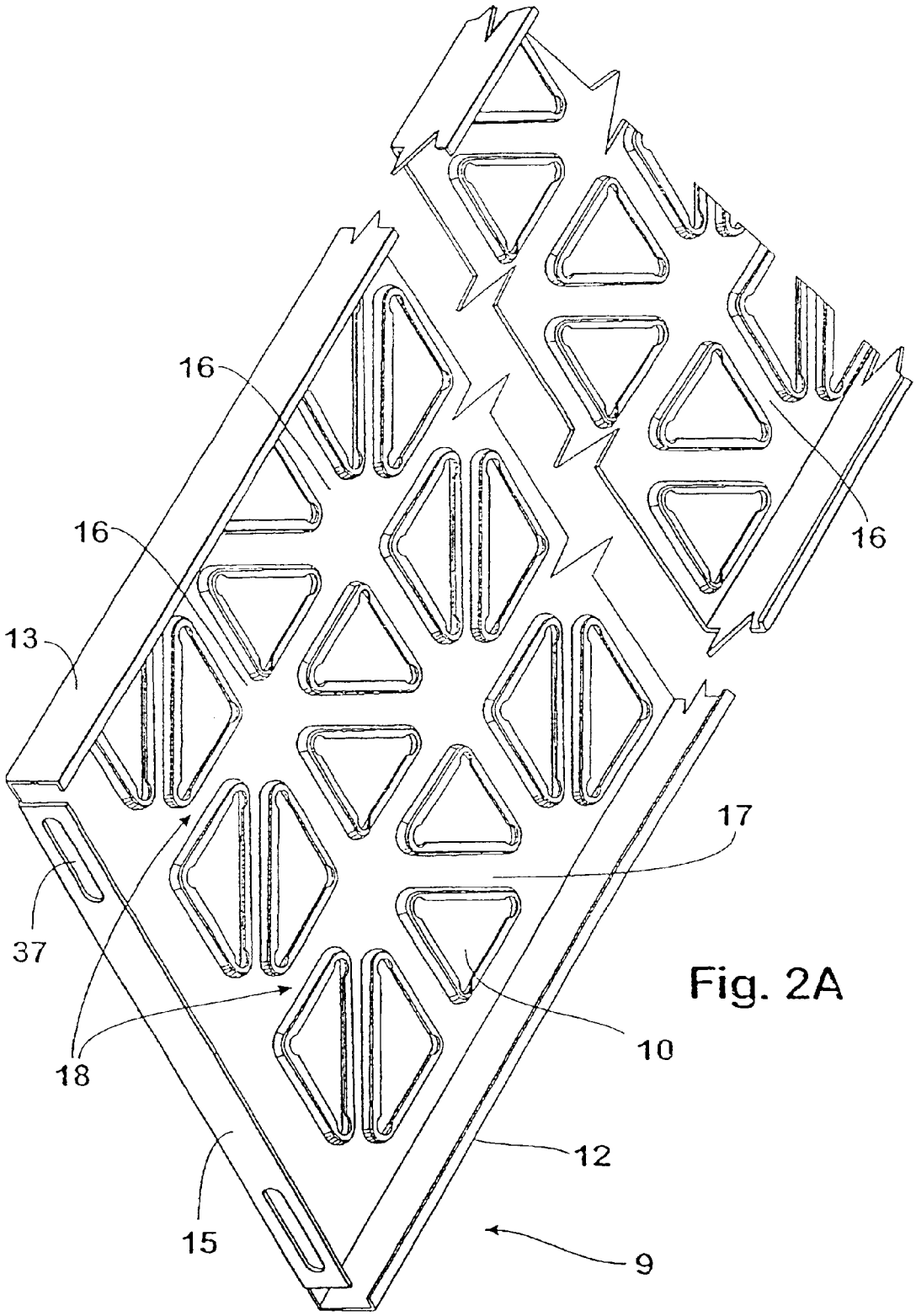
FIG. 2*a* is a cutaway perspective view of an alternate form of bracing panel and FIG. 2*b* is a perspective view of the bracing panel.
Figure 2B:
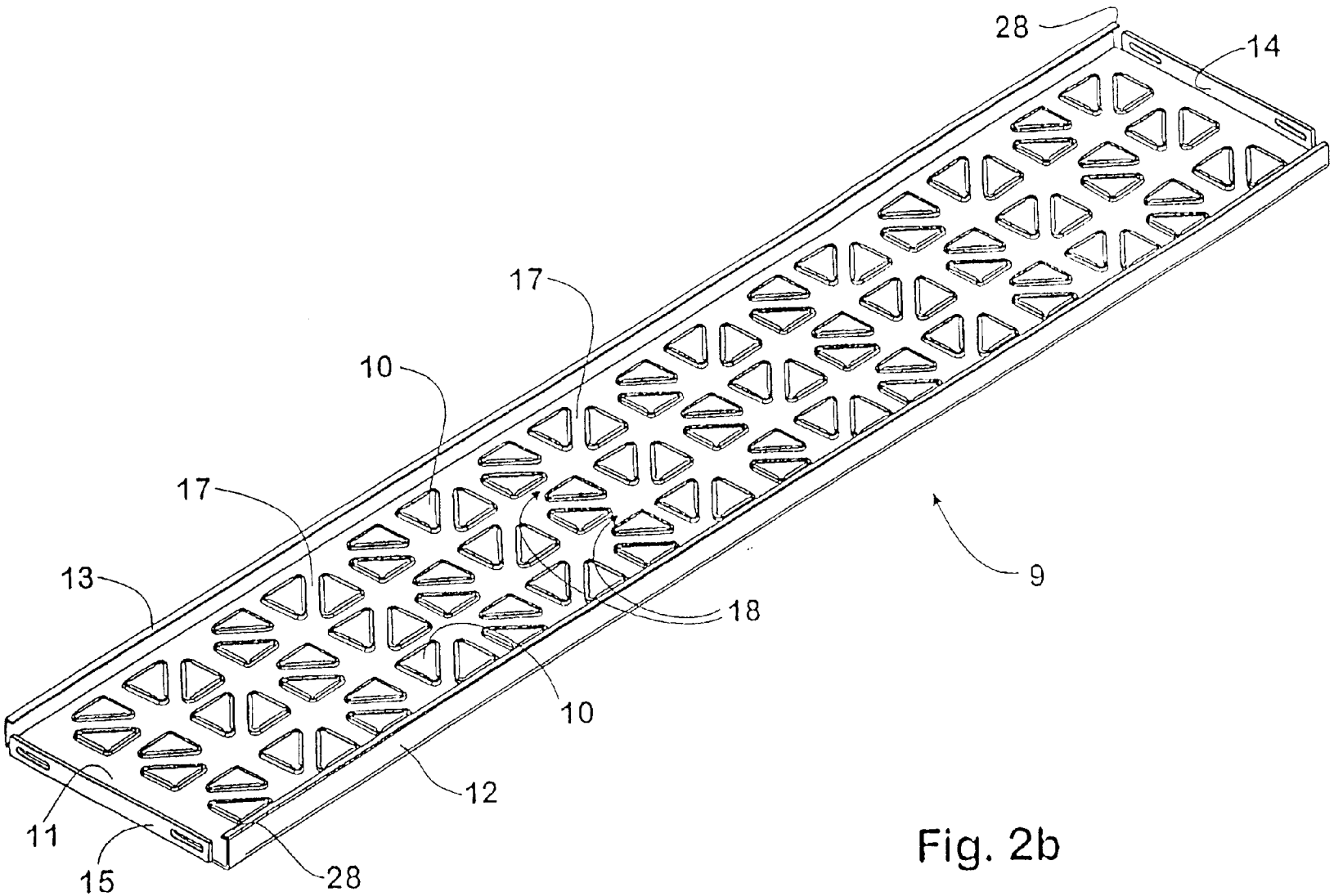

The embodiment illustrated in FIG. 2 is similar to the embodiment illustrated in FIG. 1 in that it has similar cutouts 10, however the cutouts are arranged so that in each vertical row, the strut portions 17 form a zigzag path from top to bottom of the panel 9.

In this embodiment, there are three such zigzag paths provided spaced by the two intermediate continuous panel portions 18. It is considered that this panel will be more able to take the loads applied to it than that illustrated in FIG. 1 such that it should be possible to form this panel of relatively lightweight sheet material such as 1 2mm galvanised steel sheet or lighter and still have adequate strength for performing the required bracing task. In this arrangement the cutouts 10 form pairs having their base side edge portions opposed to each other, and each pair of cutouts diagonally opposed to each other are orientated substantially 90 degrees relative to each other. In FIG. 2*a* there are shown three vertical rows of triangular cutout pairs.

Figure 3:
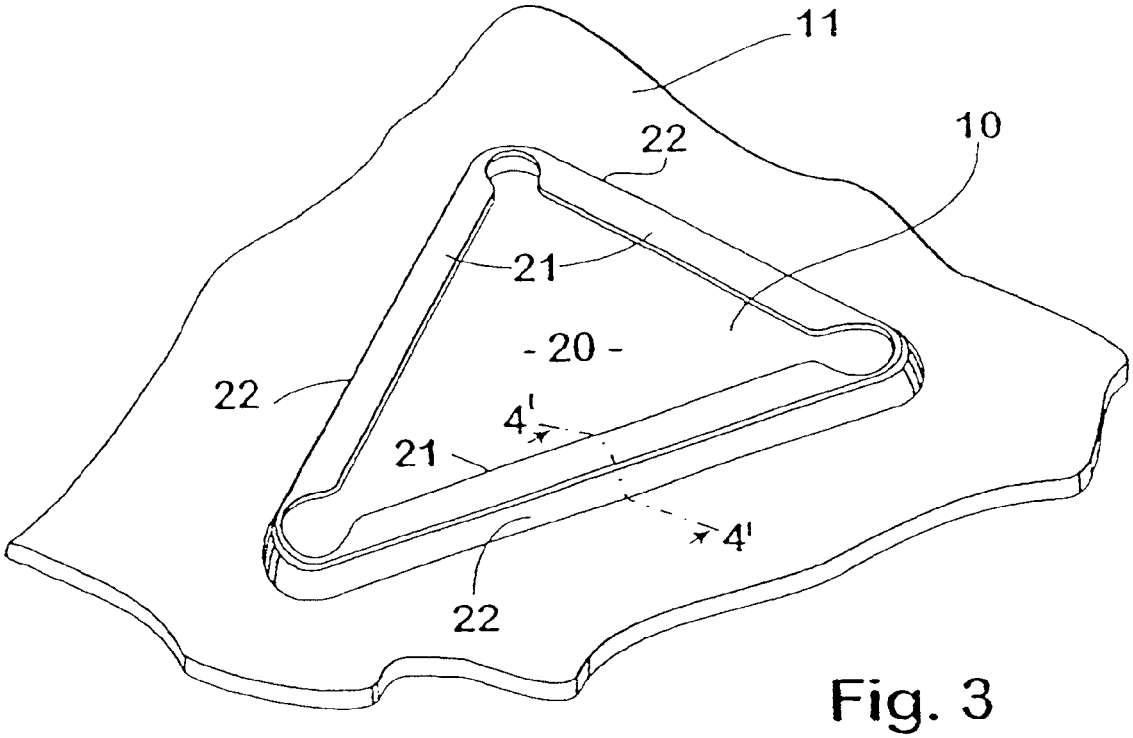
FIG. 3 is a perspective view showing the form of the cutout in the bracing panels of FIG. 1 and FIG. 2.
Figure 4:
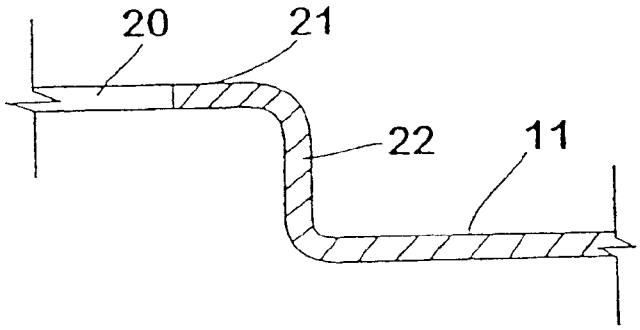
FIG. 4 is a cross-sectional view through 4'–4'of FIG. 3.

The configuration of the triangular cutouts 10 are illustrated in FIG. 3 and FIG. 4. As shown, the cutout 10 has an open base portion 20 extending between the interned flanges 21 arranged along the outer edges of flange portions 22 pressed from the panel web portion 11. The cross-sectional configuration of a typical flange assembly is shown by the cross-section 4–4' of FIG. 4, the flanges extending from the panel web portion 11 to the same side thereof as the side and end flanges 12 to 15. The web portion adjacent the cutout, the interned flange 21, and the flange portions 22 form a Z-shaped cross section.

Figure 5:
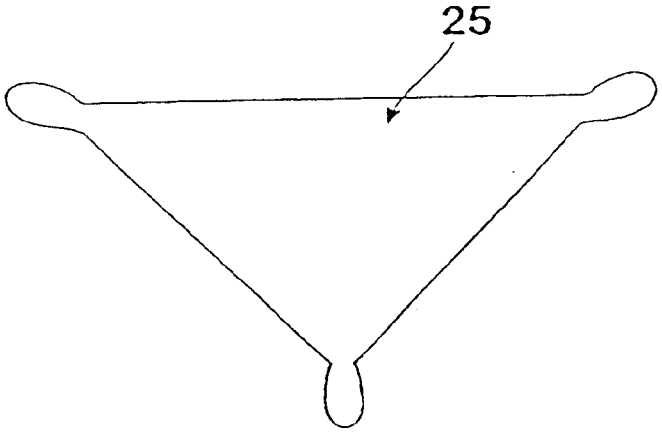
FIG. 5 illustrates the form of the aperture formed prior to pressing the side edge flanges from the body of the panel.

FIG. 5 illustrates the shape of the cutout first formed in the panel web portion 11 prior to the flanges 21 and 22 being struck, pressed or otherwise formed.

Typically, the bracing panel 9 is formed from bulk coil feedstock which is fed to forming apparatus which automatically punches out the apertures 25 as illustrated in FIG. 5 and punches the flanges 21 and 22 to their finished shape as illustrated in FIGS. 3 and 4.

Either before or after forming the cutouts 20, the sheet is cut to length and transferred to roll forming apparatus for rolling the edge flanges 12 to 15. It will be seen from the typical sectional views illustrated in FIG. 1 and 2, that the flanges 12 to 14 are also returned at 28 along their free edges in order to stiffen those flanges.

Figure 6:
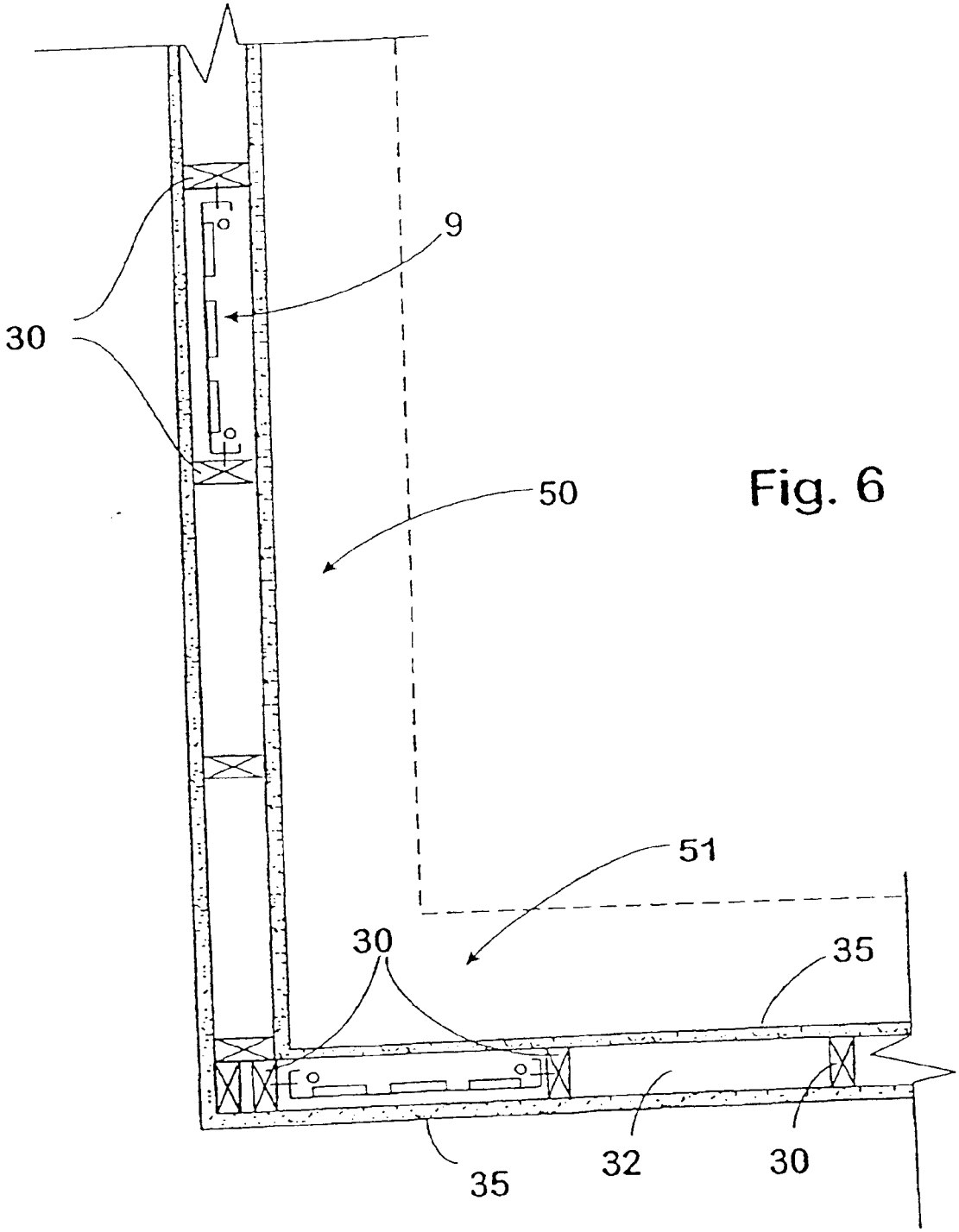
FIG. 6 is a plan view of a lined timber stud wall incorporating bracing panels made according to the present invention.
Figure 7:
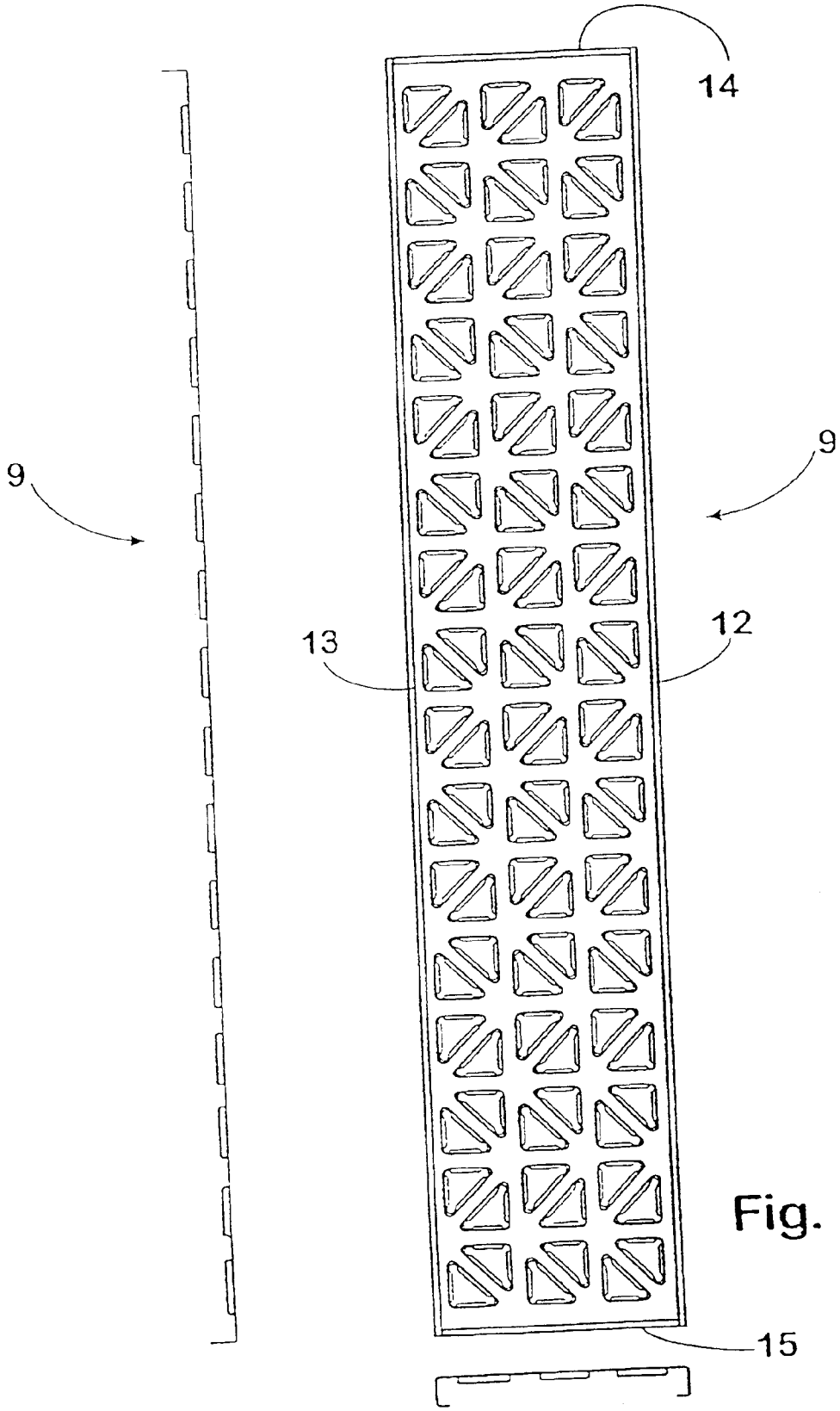
FIG. 7 illustrates collectively in plan, side and end views the bracing panel utilised in the construction of FIG. 6.
Figure 8:
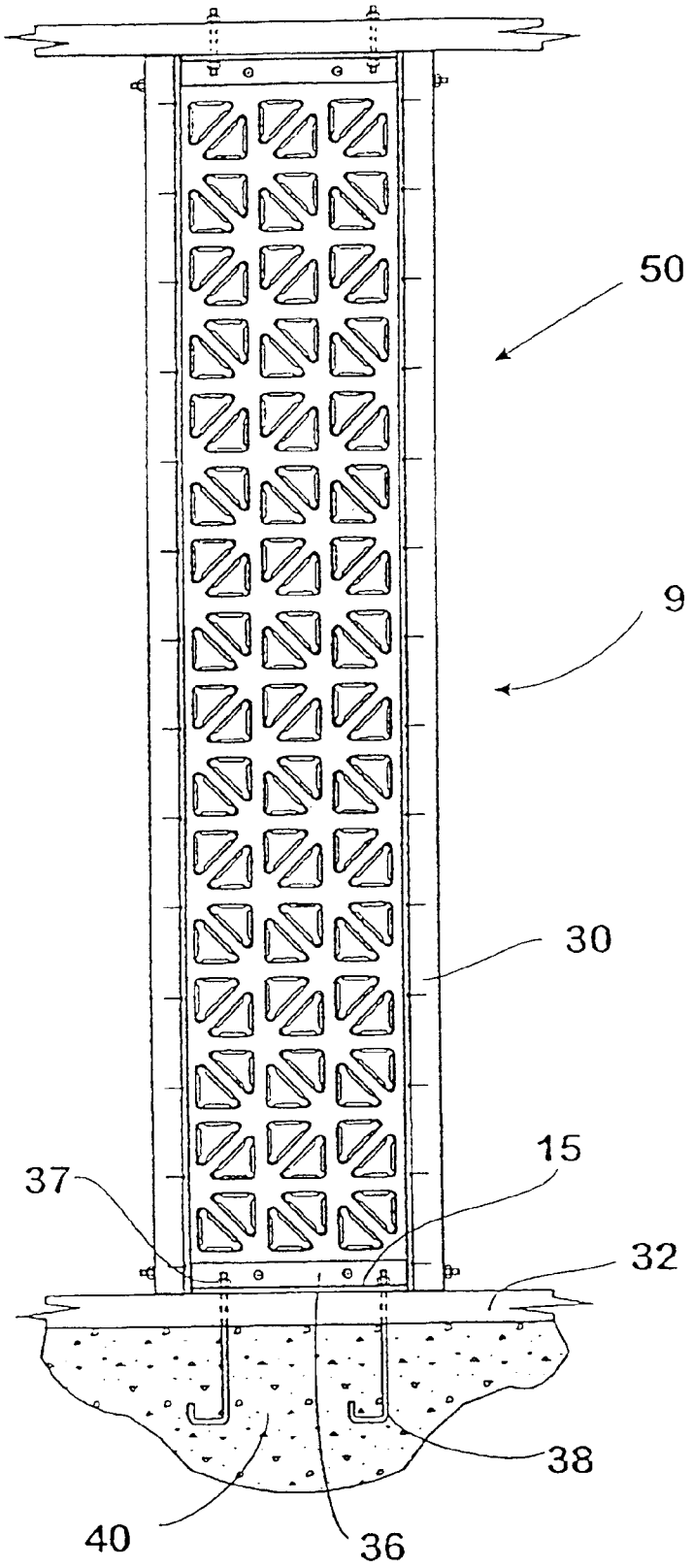
FIG. 8 illustrates the mounting details of the bracing panel in FIG. 6.

In a typical application such as for bracing a timber framed wall panel as illustrated in FIGS. 6 to 8, the bracing panel 9 is 2340 mm in height, 440 mm in width and 40 mm in depth so as to fit snugly between adjacent studs 30 and the top and bottom plates 31 and 32.

As illustrated, the overall thickness of 40 mm enables the bracing panel 9 to be located inwardly from the opposed side edges of the wall frame members, being the studs 30 and plates 31 and 32, so that it does not contact or interfere with the application of cladding 35 to the inner and outer faces of the wall structure.

Referring specifically to FIG. 8, it will be seen that the bottom flange 15 is suitably reinforced with a relatively thick angle member 36 through which the through bolts 38 pass to secure the bracing panel flange 15 to the foundation 40 so as to clamp the bottom flange 15 between the angle member 36 and the bottom plate 32 supported on the foundation 40 to securely fix the bracing panel 9 to the foundation 40. The top and bottom flanges may have elongate holes or slots through which the bolts may pass.

Suitably the apertures 37 in the bottom flange 15 and the angle member 36 are elongated along the length of the flange so as to accommodate variations in spacings of bolts 38 set into a concrete foundation or bottom plate. The slots allow accommodation of possible error during installation on site. An alternative or additional fastening is the use of tie down fasteners from the side of the panel to the concrete foundation or bottom plate. The use of tie down fasteners further stiffens the panel. (See results of stress tests of various panels in table 1.) The side flanges 12 and 13 are nailed to the studs 30 and the top flange 14 is bolted to the top plate 31. It will be seen in FIG. 6 that one bracing panel is positioned at the corner in a wall structure 51 while the other bracing panel 9 is located intermediate the length of the wall structure 50 between upright studs 30. These are typical applications provided only for the purposes of illustration.

It is considered that the structure illustrated in FIGS. 6–8 will provide sufficient racking load capacity to accommodate all normally required design loads.

Such bracing panels have the advantage that they can be efficiently manufactured from sheet metal such as galvanised steel or other non-corrosive metal and without the need for welding which destroys surface finishes and increases costs.

Furthermore, the bracing panels are relatively lightweight and can be readily stacked, transported and handled. In addition, once installed, they do not provide an obstruction to the external or internal cladding, nor do they prevent passage of services such as electrical conduit or water pipes which may pass between the bracing panel and the adjacent cladding.

Figure 9:
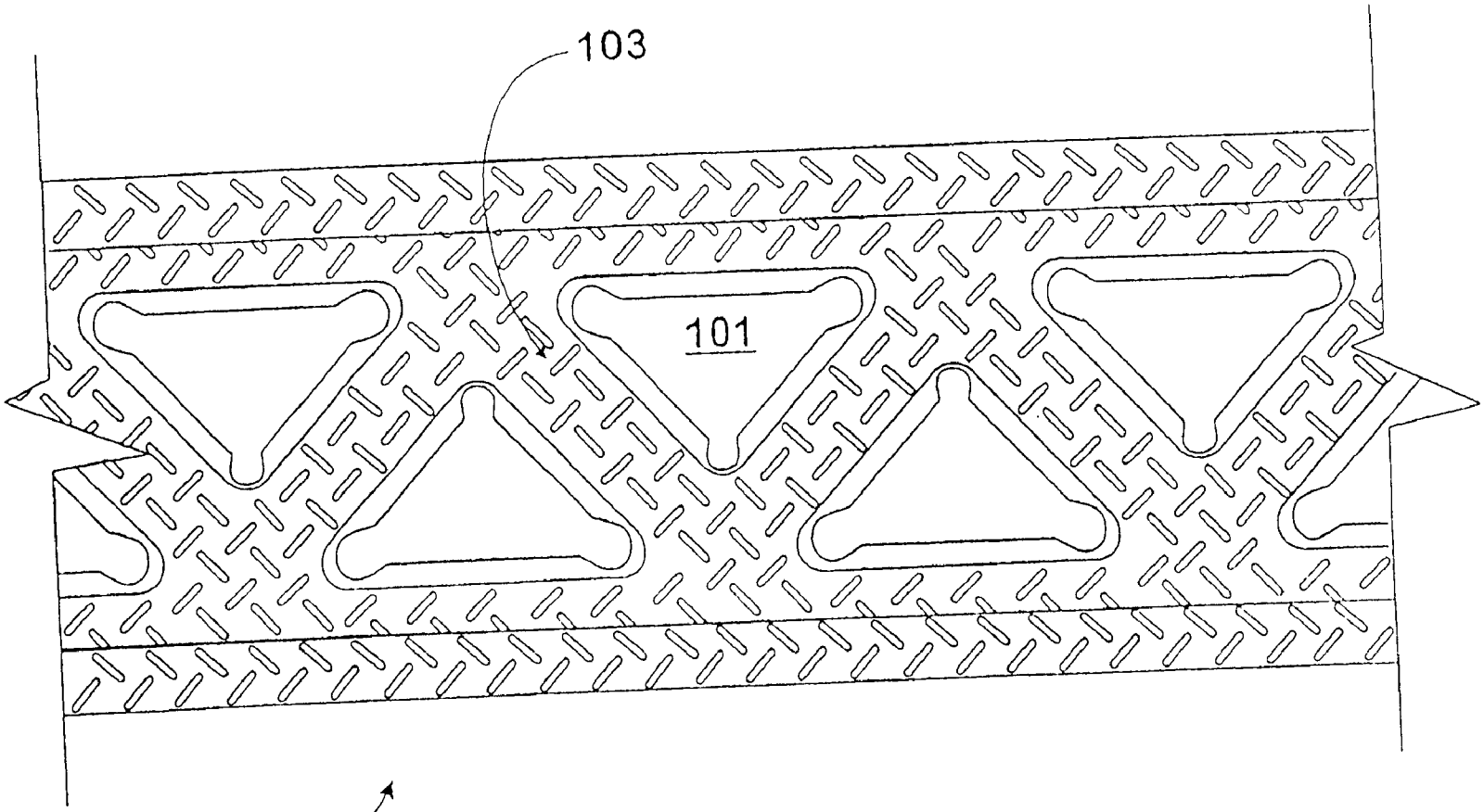
FIG. 9 shows a plan view of a C-section according to the present invention.
Figure 10:
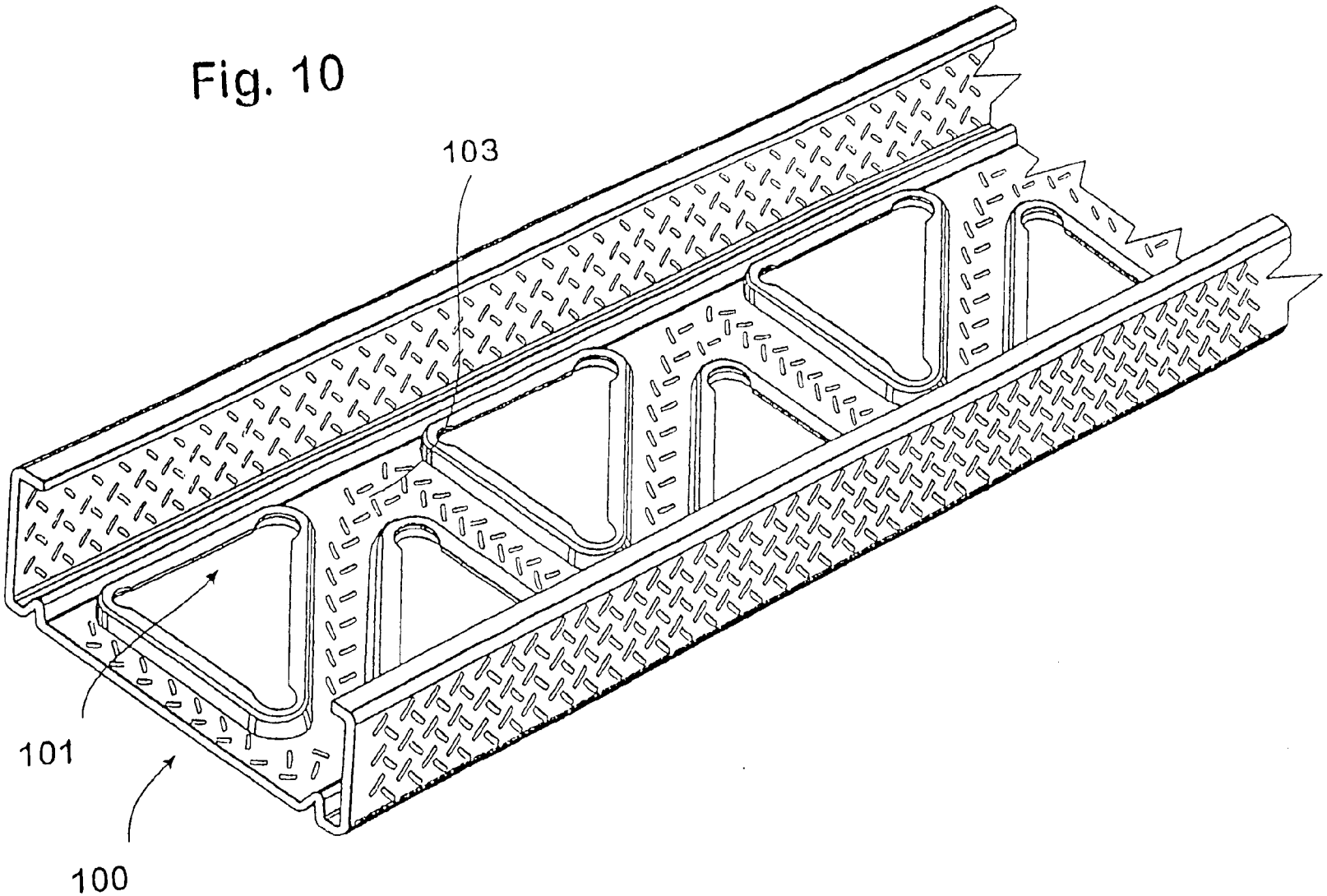
FIG. 10 is a perspective view of the C-section of FIG. 9.

FIGS. 9 and 10 show different views of a C-section structural member. The web portion 100 of the C-section structural member has a plurality of triangular cutouts 101 wherein each triangular cutout is in reverse orientation with respect to the adjacent cutout. The arrangement of the triangular cutouts relative to each other provides a series of interconnecting diagonal ribs or struts 103. These ribs or struts 103 provide the C-section structural member with additional strength and stiffness against torsional and compression forces. The triangular cutouts are suitably shaped as described above. In one embodiment the C-section has a flange height of approximately 35 mm and a web portion width of 64 to 150 mm. The C-section or the like may have one or more circular apertures through which a fastener may pass to attach the section to a support such as a stud. In FIGS. 9 and 10 the C-section has a checked pattern which helps to prevent screws and other fasteners from being withdrawn. The various sections may have other types of patterns such as diamond shaped patterns, criss-cross pattern or stippling and rib patterns which strengthen the member or increase the holding capacity for fasteners. The C-sections may be used as studs for connection to the bracing panels or floor joists.

In FIG. 11 there is shown a Z-section structural member 109 which has triangular cutouts 110 along its web section 111 in an orientation where each cutout is in reverse orientation with respect to the adjacent cutout. The shape of the triangular cutouts 110 and their arrangement along the web section 111 provides the member with strength and stiffness. The web section 111 spaces flanges 112 from each other. The Z-section structural members suitably form purlins.

Figure 12:
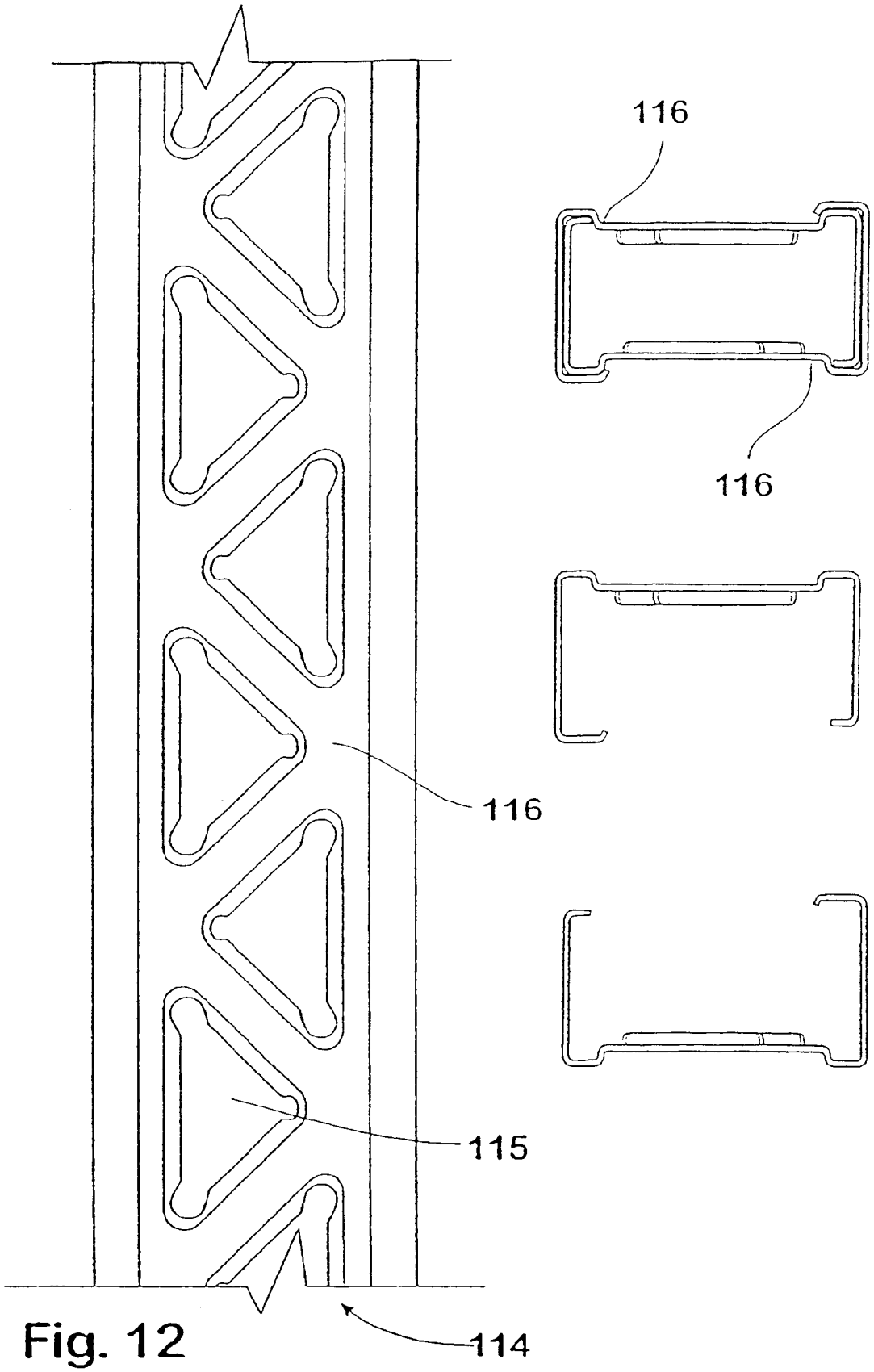
FIG. 12 is plan and sectional views of a beam according to the present invention.

In FIG. 12 there is shown a box section member 114 which has triangular cutouts 115 along each opposing side of the web portion 116, each of which are in a reversed orientation with respect to the adjacent cutout. The box sections are preferably made up of two C-sections locked together to form a box beam. These box section members suitably form beams for building. Both the Z-section structural members and the box section structural members may have circular apertures along the web portions 111 and 116 to provide a locating means or fastening means.

The bracing panel as described above is a light weight steel product constructed from a one piece panel formed by pressing/punching on a roll forming machine and designed to support vertical loads and resist in-plane and out of plane lateral loads resulting from wind forces. The panel is made in the factory and no welding or joining is required on site. The panel is easily installed on site with the fixing of various fasteners. Unlike conventional plywood sheeting which requires the outer cladding of the whole wall to be pulled down so that damaged sheeting can be replaced, the bracing panel of the current invention may be replaced when damaged by removing the section of the internal or external wall cladding adjacent the panel to be replaced.

The panels can be made to standard 8 foot and 9 foot heights, widths of standard 16 and 24 inches, and fit within 3, 4 and 6 inch stud walls.

TABLE 1 sets out the results of stress tests on a light weight galvanised steel (19 gauge) panels of various widths and heights with and without tie down fasteners.

| # PANEL WIDTH (inches) L | # PANEL HEIGHT (inches) H | ALLOWING RACKING SHEAR P (lbf) | MAXIMUM IN-PLANE DEFLECTION (inch) Δ | + STIFFNESS (lbf/inch) G |
|---|---|---|---|---|
| 14.5 | 92.7 | 305 | 0.5 | 3,900 |
| 14.5 | 92.7 | 450* | 0.5* | 5,750* |
| 17.3 | 92.125 | 315 | 0.5 | 3,350 |
| 23.2 | 92.125 | 395 | 0.5 | 3,130 |

For SI: inch=25.4 mm, I lbi=4.45N, 1 lbf/inch=175Nlm.
>Racking Shear applies to wind resistance only. Earthquake resistance is beyond the scope of these assessments.
#Dimensional tolerances are+or −½ inch.
+In plane deflection may be determined using the following equation:

$$\Delta=(P>\times H)/(G>\times L)$$

Δ=In plane deflection, inch (mm)
P=Racking shear, lbf(N).
H=Shear wall height, inch (mm)
G=Stiffness, lbf/inch (N/m)
L=Shear wall width, inch (mm)
*Values apply with Tie-Down Angle replacing steel angle.

It will of course be realised that the above has been given by way of illustrative example only and that all such and other variations and modifications thereto as would be apparent to persons skilled in the art are deemed to fall within the broad scope and ambit of this invention as is hereinafter set forth.

What is claimed is:

1. A structural member including a panel portion having a plurality of triangular recesses, said triangular recesses being similar in size and arranged in pairs, wherein:

strut portions are defined between spaced apart opposing side edges of the triangular recesses, each said pair which is diagonally opposed to another said pair is oriented substantially 90 degrees relative to each other, said pairs are substantially evenly spaced across the panel portion and are arranged in three or more longitudinal rows and three or more transverse rows whereby said rows form longitudinal and transverse portions between portions between the rows, said strut portions extend between said longitudinal or transverse portions and each of said strut portions is not aligned with adjacent strut portions, whereby the arrangement of the triangular recesses across the panel portion increases the ductility of the panel portion.

2. A structural member as claimed in claim 1, wherein each of said recesses comprises three intermediate portions and a floor portion positioned between the intermediate portions and displaced from the plane of the panel portion.

3. A structural member including a panel portion having a plurality of triangular recesses, said triangular recesses being similar in size and arranged in pairs, wherein:

strut portions are defined between spaced apart opposing side edges of the triangular recesses, each said pair which diagonally opposed to another said pair is oriented substantially 90 degrees relative to each other, said pairs are substantially evenly spaced across the panel portion and are arranged in three or more longitudinal rows and three or more transverse rows whereby said rows form longitudinal and transverse portions between the rows, said strut portions extend said longitudinal or transverse portions and each of said strut portions is no aligned with adjacent strut portions, and each of said recesses is a cutout with a side edge portions displaced from the plane of the panel portion and comprising an intermediate portion and lip extending inwardly within the cutout.

4. A structural member as claimed in claim 3 wherein said cutout comprises an intermediate portion at substantially 90 degrees from the plane of the panel portion and a lip extending inwardly within the cutout and substantially parallel with the panel portion.

5. A structural member as claimed in claim 4, wherein said cutout is substantially in the shape of an equilateral triangle.

6. A structural member as claimed in claim 4, wherein said cutout is substantially in the shape of an equilateral triangle, said cutout having three corner portions each of which are rounded or arcurate.

7. A structural member as claimed in claim 4, wherein said cutout is substantially in the shape of an equilateral triangle having three corner portions each of which is rounded or arcurate, and said panel portion has one or more ribs to provided stiffness.

8. A structural member as claimed in claim 3 wherein the structural member is a bracing panel and said cutout comprises an intermediate portion at substantially 90 degrees from the plane of the panel portion and a lip extending inwardly within the cutout and substantially parallel with the panel portion, said cutout being substantially in the shape of an equilateral triangle and having three corner portions each of which are rounded or arcurate.

9. A structural member as claimed in claim 8, wherein said bracing panel has one or more perimeter flanges for attachment purposes.

10. A structural member as claimed in claim 8 wherein said bracing panel has one or more perimeter flanges for attachment to framing, said braces panel includes a reinforced lower flange to resist racking loads applied to the framing.

* * * * *